US010590599B2

(12) United States Patent
Miyamoto et al.

(10) Patent No.: US 10,590,599 B2
(45) Date of Patent: Mar. 17, 2020

(54) MODIFIED FIBER AND METHOD FOR PRODUCING SAME

(71) Applicant: KB TSUZUKI K.K., Nagoya-shi, Aichi (JP)

(72) Inventors: Hiroshi Miyamoto, Kasugai (JP); Motohisa Noma, Imabari (JP); Atsushi Hirosue, Setouchi (JP)

(73) Assignee: KB TSUZUKI K.K., Nagoya-shi, Aichi (JP)

( * ) Notice: Subject to any disclaimer, the term of this patent is extended or adjusted under 35 U.S.C. 154(b) by 323 days.

(21) Appl. No.: 15/101,361

(22) PCT Filed: Dec. 3, 2013

(86) PCT No.: PCT/JP2013/082426

§ 371 (c)(1),
(2) Date: Jun. 2, 2016

(87) PCT Pub. No.: WO2015/083227

PCT Pub. Date: Jun. 11, 2015

(65) Prior Publication Data

US 2016/0305062 A1 Oct. 20, 2016

(51) Int. Cl.

| | |
|---|---|
| ***D06M 15/647*** | (2006.01) |
| ***D06M 11/44*** | (2006.01) |
| ***D06M 11/83*** | (2006.01) |
| ***D06M 101/06*** | (2006.01) |
| ***D06M 101/10*** | (2006.01) |

(52) U.S. Cl.

CPC ..... *D06M 15/647* (2013.01); *D06M 11/44* (2013.01); *D06M 11/83* (2013.01); *D06M 2101/06* (2013.01); *D06M 2101/10* (2013.01)

(58) Field of Classification Search

CPC .... D06M 15/647; D06M 11/83; D06M 11/44; D06M 2101/06; D06M 2101/10; Y10T 442/2164; Y10T 442/2172; Y10T 442/2262; Y10T 442/2279; Y10T 442/2525; C08G 77/00; C09D 183/00; C08L 83/00

See application file for complete search history.

(56) References Cited

U.S. PATENT DOCUMENTS

| | | | | |
|---|---|---|---|---|
| 4,436,856 | A * | 3/1984 | Huhn | C08L 83/04 106/287.11 |
| 4,559,056 | A | 12/1985 | Leigh et al. | |
| 5,158,575 | A * | 10/1992 | Czech | D06M 15/647 427/387 |
| 5,232,611 | A | 8/1993 | Ohashi et al. | |
| 2005/0123689 | A1* | 6/2005 | Branlard | C09D 183/04 427/515 |
| 2009/0196791 | A1* | 8/2009 | Ogata | B01J 35/004 422/40 |
| 2015/0079863 | A1* | 3/2015 | Majumdar | C09K 3/16 442/110 |
| 2015/0159318 | A1* | 6/2015 | Amatani | D06M 13/144 252/8.63 |

FOREIGN PATENT DOCUMENTS

| | | | |
|---|---|---|---|
| CN | 102898654 | A | 1/2013 |
| JP | S60-039486 | A | 3/1985 |
| JP | H03-206184 | A | 9/1991 |
| JP | 8-134780 | A | 5/1996 |
| JP | 2008-202174 | A | 9/2008 |
| JP | 2012-26053 | A | 2/2012 |

OTHER PUBLICATIONS

Nadanathangam Vigneshwaran, "Functional finishing of cotton fabrics using zinc oxide-soluble starch nanocomposites" 2006, Nanotechnology 17 5087 (Year: 2006).*

Chinese Office Action and Chinese Search Report, dated Feb. 3, 2017, for Chinese Application No. 201380081382.9, with an English translation of the Chinese Office Action.

International Search Report, issued in PCT/JP2013/082426, dated Feb. 10, 2014.

Indian Office Action for Application No. 201647022056, dated Feb. 18, 2019, with English language translation.

* cited by examiner

*Primary Examiner* — Jennifer A Steele

(74) *Attorney, Agent, or Firm* — Birch, Stewart, Kolasch & Birch, LLP

(57) ABSTRACT

A modified fiber and a method for producing the same. The modified fiber is obtained by modifying a fiber material containing at least one of a cellulosic fiber and an animal fiber. In the modified fiber, a film of a silicone elastomer is attached to at least a portion of a surface of the fiber material, the silicone elastomer contains a polyoxyethylene alkyl ether having 12 to 15 carbon atoms as a main component and has a siloxane skeleton, and the surface has a surface tension of 30 to 70 mN/m.

7 Claims, No Drawings

MODIFIED FIBER AND METHOD FOR PRODUCING SAME

TECHNICAL FIELD

The present invention relates to a modified fiber, obtained by modifying a natural fiber containing at least one of a cellulosic fiber or an animal fiber, and a method for producing the same.

BACKGROUND ART

In general, fibers derived from natural materials such as cellulosic fibers and animal fibers (hereinafter referred to also as natural fibers) are more excellent in hygroscopicity and water absorbability than synthetic fibers. However, when washed in water, the natural fibers tend to be swollen and thereby be hardened, embrittled, or whitened. Furthermore, the natural fibers are disadvantageously inferior in wrinkle resistance and strength to the synthetic fibers.

Therefore, there is a demand for modifying the natural fiber without deteriorating its inherent hygroscopicity and water absorbability, thereby producing a modified fiber having washing durability, strength, and the like equal to those of the synthetic fiber. For example, a method for providing sheep wool in a natural fiber with water-repellent/oil-repellent properties is proposed in Japanese Laid-Open Patent Publication No. 08-134780. Specifically, a wool fiber is subjected to an oxidation treatment, and a polysiloxane resin such as dimethylpolysiloxane and a fluorine compound such as a polytetrafluoroethylene resin are adsorbed in this order to the wool fiber, to form a water-repellent/oil-repellent coating. However, in this case, the adhesion is insufficient between the wool fiber and the coating. Thus, the coating is often peeled off in a washing process or the like, whereby the water-repellent/oil-repellent properties are often deteriorated.

In view of the above problem, for example, Japanese Laid-Open Patent Publication No. 2008-202174 discloses an animal hair fiber containing sheep wool, a water-repellent/oil-repellent coating containing a fluorine-containing acrylate resin or the like, and an intermediate coating layer formed therebetween, which contains a polyamide-epichlorohydrin or the like capable of forming a covalent bond with the animal hair fiber. In this case, because the covalent bond is formed between the intermediate coating layer and a functional group in the animal hair fiber, the adhesion between the water-repellent/oil-repellent coating and the animal hair fiber is improved by the intermediate coating layer, whereby the water-repellent/oil-repellent properties last longer.

SUMMARY OF INVENTION

Meanwhile, fashion colors and patterns of textile products (commercial products) are rapidly changed. Therefore, sewn products dyed in advance with predetermined colors may become unsuitable for consumer tastes in a short period, and may remain as unsold stock. In order to reduce the unsold stock in view of effective utilization of resources, it is necessary to provide commercial products consistent with the fashion colors and patterns of the time in a short period. In this case, it is preferred that a modified fiber is stored in the undyed and unsewn state, dyed based on market information collected immediately before the sale timing, and then rapidly sewn to provide a fiber product. Thus, it is important that a natural fiber can be dyed after modification, in other words, the modified fiber can be piece-dyed.

However, the modified fiber obtained by the technology described in Japanese Laid-Open Patent Publication No. 2008-202174 cannot be piece-dyed. In the case of dyeing the natural fiber with a reactive dye, a threne dye, or the like, the functional group in the natural fiber has to be reacted with the dye. However, since the covalent bond is formed between the functional group and the intermediate coating layer, the dye is prevented from adsorbing to the natural fiber, and generation of color unevenness or the like cannot be easily avoided.

As is clear from above, it is difficult to produce a piece-dyeable, modified fiber with excellent durability.

In view of the above problems, an object of the present invention is to provide a modified fiber containing a natural fiber, which can be produced with excellent durability while maintaining the sufficient hygroscopicity of the natural fiber and can be easily dyed, and a method for producing the same.

To achieve the above object, in the present invention, a modified fiber is produced by modifying a fiber material containing at least one of a cellulosic fiber and an animal fiber, a film of a silicone elastomer is attached to at least a portion of a surface of the fiber material, the silicone elastomer contains a polyoxyethylene alkyl ether having 12 to 15 carbon atoms as a main component and has a siloxane skeleton, and the surface has a surface tension of 30 to 70 mN/m.

In the modified fiber of the present invention, the film of the silicone elastomer is adhered, due mainly to a mechanical action such as an anchor effect, to the fiber material containing at least one of the cellulosic fiber or the animal fiber (hereinafter referred to also as the natural fiber). In other words, most of functional groups in the natural fiber do not form a chemical bond such as a covalent bond with the silicone elastomer film. Therefore, in the case of dyeing the modified fiber, the functional groups in the natural fiber can be sufficiently reacted with a dye, so that the dye can be desirably adsorbed to the natural fiber while preventing generation of color unevenness. Thus, the modified fiber can exhibit an excellent dyeing affinity and can be easily piece-dyed.

The silicone elastomer film can be expanded and contracted in accordance with deformation of the natural fiber, and thereby can maintain the strong attachment to the surface of the natural fiber. Therefore, even when a frictional force or the like is applied to the modified fiber in water or an agent in the process of washing, dyeing, etc., the silicone elastomer can be prevented from being peeled off from the surface of the natural fiber and can exhibit an excellent durability.

Furthermore, the surface tension of the modified fiber is controlled within the range of 30 to 70 mN/m by forming the silicone elastomer film in the above manner. Thus, the natural fiber is modified to have a surface tension comparable to synthetic fibers. Therefore, the swelling of the natural fiber in water washing or the like, which is known as a drawback of the natural fiber, can be prevented, and the softness, strength, dyeing resistance, wrinkle resistance, and the like can be desirably improved. Consequently, the modified fiber containing the natural fiber can be produced with excellent physical properties equal to those of the synthetic fibers.

Furthermore, the modified fiber can be more excellent in hygroscopicity and water absorbability than the synthetic fibers. As described above, in the modified fiber, most of the functional groups in the natural fiber are not reacted with the silicone elastomer film. Consequently, the modified fiber can capture water molecules due to hydrophilicity of the functional groups, and thereby can show an excellent hygroscopicity.

The silicone elastomer film is a porous film having a plurality of micropores, and the surface of the film has a scale-like shape. Water can be readily spread on the film surface having such a shape. In addition, the modified fiber can absorb water through the micropores. Thus, the modified fiber can exhibit an excellent water absorbability because of the structure of the silicone elastomer film.

As described above, the modified fiber can exhibit excellent physical properties and durability like the synthetic fibers while maintaining sufficient hygroscopicity of the natural fiber, and can be easily piece-dyed. Consequently, commercial products consistent with consumer tastes can be rapidly provided from the modified fiber, and the unsold stock can be reduced.

In the modified fiber, it is preferred that the silicone elastomer film contains conductive fine particles, which contain an n-type semiconductor containing zinc oxide as a main component. The conductive fine particle can absorb ultraviolet light, and can absorb and reflect infrared light. In contrast, visible light can be transmitted through the conductive fine particle. Thus, the silicone elastomer film containing the conductive fine particles can act to provide the modified fiber with an ultraviolet shielding function and an infrared shielding function without deteriorating the color of the modified fiber. Furthermore, this silicone elastomer film can act to provide the modified fiber with an excellent conductivity, and therefore can act as an antistatic to effectively prevent electrostatic generation. In addition, this silicone elastomer film can act to provide the modified fiber with excellent deodorant and antibacterial properties.

In general, a person wearing clothing often feels stimulation by the clothing when static electricity generated on the clothing surface acts on open skin pores or when a harder fiber is brought into contact with open skin pores. The conductive fine particle containing the zinc oxide as a main component has an astringent function. Therefore, cloth made from the modified fiber containing the conductive fine particles can close the pores of the skin of the person wearing the cloth. Furthermore, as described above, in this modified fiber, the electrostatic generation can be prevented by the conductive fine particles, and the softness can be improved by the silicone elastomer film. Consequently, the stimulation on the clothed person can be reduced.

As described above, in a case where the silicone elastomer film containing the conductive fine particles is tightly attached to the natural fiber in the modified fiber, the conductive fine particles are strongly held on the surface of the natural fiber. Therefore, the above described functions achieved due to the conductive fine particles are hardly deteriorated in the process of washing the modified fiber or the like, and can be maintained with excellent durability.

It is further preferred that the zinc oxide is doped with at least one of aluminum and gallium in the conductive fine particles. In this case, the conductivity of the modified fiber can be further improved.

In the present invention, a method for producing a modified fiber from a fiber material containing at least one of a cellulosic fiber and an animal fiber comprises the steps of immersing the fiber material in an aqueous dispersion liquid containing particles of a silicone elastomer (which contains a polyoxyethylene alkyl ether having 12 to 15 carbon atoms as a main component and has a siloxane skeleton) and cross-linking the particles in a heating treatment, thereby adhering a film of the silicone elastomer to a surface of the fiber material, to produce a modified fiber having a surface tension of 30 to 70 mN/m.

In the modified fiber produced by the above steps, the film of the silicone elastomer, which can be expanded and contracted in response to deformation of the natural fiber, can be strongly adhered to the natural fiber surface due mainly to a mechanical action such as an anchor effect. Thus, in this modified fiber, the silicone elastomer film can be strongly adhered to the natural fiber, while most of functional groups in the natural fiber can be reacted with a dye. Consequently, the modified fiber has an excellent dyeing affinity and can be easily piece-dyed.

The modified fiber has a controlled surface tension approximately equal to those of synthetic fibers. Therefore, the modified fiber can be prevented from swelling in water washing or the like while containing the natural fiber, and can exhibit excellent physical properties such as softness, strength, dyeing resistance, and wrinkle resistance approximately equal to those of the synthetic fibers. Furthermore, as described above, since the functional groups are not chemically bonded with the silicone elastomer film, the modified fiber can draw water molecules due to hydrophilicity of the functional groups and thereby can show an excellent hygroscopicity.

The silicone elastomer film is a porous film having a plurality of micropores, and the surface of the film has a scale-like shape. Therefore, the modified fiber can exhibit an excellent water absorbability.

In the production method of the modified fiber, it is preferred that conductive fine particles, which contain an n-type semiconductor containing zinc oxide as a main component, are attached to the surface of the modified fiber by adding the conductive fine particles to the aqueous dispersion liquid. The conductive fine particles can be strongly held on the surface of the modified fiber by adding the conductive fine particles to the silicone elastomer film tightly attached to the natural fiber as described above. Thus, by adding the conductive fine particles, the modified fiber can be provided with an ultraviolet shielding function and an infrared shielding function without deteriorating the color of the modified fiber. In addition, the modified fiber can exhibit excellent deodorant and antibacterial properties.

Furthermore, the conductive fine particles can act as an antistatic to prevent electrostatic generation, and can exhibit an astringent function to close the skin pores of the persons wearing the clothes containing the modified fiber. In addition, the modified fiber can exhibit an excellent softness to reduce the stimulation on the clothed person.

It is preferred that the zinc oxide is doped with at least one of aluminum and gallium. In this case, the conductivity of the modified fiber can be further improved.

It is preferred that the heating treatment is carried out in a steam set using a water vapor. In this case, for example, by using a saturated vapor having a temperature of 100° C. or lower, the silicone elastomer particles can be cross-linked, and the modified fiber can be produced with a further improved softness. Furthermore, the saturated vapor can penetrate even a space between stacked natural fiber pieces, and thereby can effectively supply heat all over the entire natural fiber uniformly. Thus, for example, in a case where the natural fiber is in the state of a wound yarn, the saturated vapor can supply heat even to the natural fiber pieces inside the wound yarn, to effectively cross-link the silicone elastomer particles. In addition, in the steam set, the ambient atmosphere of the natural fiber can be filled with the saturated vapor to prevent generation of active oxygen or the like. Consequently, the modified fiber can be desirably prevented from being damaged or embrittled by the active oxygen.

DESCRIPTION OF EMBODIMENTS

A preferred embodiment of the modified fiber of the present invention will be described together with a method for producing the same in detail below.

The modified fiber of the present invention is obtained by modifying a fiber material containing at least one of a cellulosic fiber and an animal fiber. Thus, the natural fiber may contain only the cellulosic fiber, only the animal fiber, or both of the cellulosic fiber and the animal fiber. The fiber material may contain a synthetic fiber in addition to the natural fiber.

The shape of the fiber material is not particularly limited, and the fiber material may be in the state of cotton ball, tow, filament, sliver, yarn, non-woven fabric, woven fabric, knitted fabric, towel, etc.

Typical examples of the cellulosic fibers include natural plant fibers of cottons (cotton fibers). Alternatively, the cellulosic fiber may be a hemp-type material such as a ramie, linen, cannabis (hemp), jute, manila hemp, or sisal hemp. Furthermore, the cellulosic fiber may be a so-called regenerated fiber prepared by dissolving a natural cellulose in a predetermined solvent and shaping the cellulose into a fiber form. Specific examples of such regenerated fibers include rayons, polynosics, cupras, Tencels (registered trademark of Lenzing Aktiengesellschaft, Austria).

On the other hand, typical examples of the animal fibers include silks, sheep wools, and animal hair fibers. Specific examples of the animal hair fibers include alpacas, mohairs, angoras, cashmeres, camels, and vicugnas.

Examples of the synthetic fibers include polyesters, polyurethanes, aliphatic polyamide-based fibers (including 6-nylon and 6,6-nylon), and aromatic polyamide-based fibers.

The ratios of the cellulosic fiber, the animal fiber, and the synthetic fiber in the fiber material (the modified fiber) are not particularly limited and may be desirably selected.

The modified fiber is provided by attaching a film of a silicone elastomer to at least a portion of a surface of the natural fiber in the fiber material. The silicone elastomer contains a polyoxyethylene alkyl ether having 12 to 15 carbon atoms as a main component and has a siloxane skeleton. The surface tension of the modified fiber is controlled by the silicone elastomer film within the range of 30 to 70 mN/m.

More specifically, the silicone elastomer film is a porous film having a plurality of micropores, and the surface thereof has a scale-like shape. The silicone elastomer film is attached to the natural fiber surface due mainly to a mechanical action such as an anchor effect. Meanwhile, most of functional groups in the natural fiber do not form a chemical bond such as a covalent bond with the silicone elastomer film. Therefore, in the case of dyeing the modified fiber, the functional groups in the natural fiber can be sufficiently reacted with a dye, so that the dye can be desirably adsorbed to the natural fiber while preventing generation of color unevenness. Thus, the modified fiber can exhibit an excellent dyeing affinity and can be easily piece-dyed.

The silicone elastomer film can be expanded and contracted using its elasticity in response to deformation of the natural fiber, and thereby can maintain the strong attachment to the surface of the natural fiber. Therefore, even when a frictional force or the like is applied to the modified fiber in water or an agent in the process of washing, dyeing, etc., the silicone elastomer can be prevented from being peeled off from the surface of the natural fiber and can exhibit an excellent durability.

Thus, the modified fiber can exhibit the excellent dyeing affinity while maintaining the strong attachment of the silicone elastomer film to the natural fiber surface, and can be easily piece-dyed. The modified fiber can be stored in the undyed and unsewn state, dyed based on fashion color information collected immediately before the sale timing, and then rapidly sewn to provide a fiber product. Therefore, though fashion colors and patterns are rapidly changed, commercial products consistent with the fashion colors and patterns of the time can be provided in a short period by using the modified fiber. Consequently, by using the modified fiber, the unsold stock of the commercial products can be reduced in view of effective utilization of resources, and the cost of sewn products can be ultimately reduced.

As described above, the modified fiber having the silicone elastomer film has a surface with a surface tension of 30 to 70 mN/m. The surface tension can be measured by a so-called Dupont method. Specifically, first, isopropyl alcohol (IPA) is mixed with a distilled water to prepare 12 mixed reagents having different concentrations. The 12 mixed reagents are classified by 1st to 12th grades corresponding to mixing ratios shown in Table 1. Also the surface tensions of the grades are shown in Table 1.

The surface tension of a measurement sample can be evaluated by dropping the mixed reagents onto the sample e.g. in the order of 1st to 12th. More specifically, five (5) droplets of each of the mixed reagents are applied onto the sample such that each of the applied five droplets has a diameter of about 3 mm on the sample. Then, after the sample is left at rest for 10 seconds, the mixed reagents, of which 2 to 3 droplets are still in the droplet state, are selected. The surface tension of the mixed reagent having the largest-number grade among the selected reagents is considered as the surface tension of the sample.

In surface tension comparison between a solid and a liquid, when the surface tension of the liquid is larger than that of the solid, the liquid is likely to be repelled by the solid. Therefore, since the modified fiber of this embodiment has the surface tension controlled within the above range, when the mixed reagents of the 5th to 12th grades are dropped onto the modified fiber, the mixed reagents are not maintained in the droplet state and penetrate into the modified fiber. In addition, water having a surface tension of 72 mN/m hardly penetrates into the modified fiber.

TABLE 1

| | Volume % | | Surface tension |
|---|---|---|---|
| Grade | IPA | Distilled water | (mN/m) |
| 1 | 2 | 98 | 59.0 |
| 2 | 5 | 95 | 50.0 |
| 3 | 10 | 90 | 42.0 |
| 4 | 20 | 80 | 33.0 |
| 5 | 30 | 70 | 27.5 |
| 6 | 40 | 60 | 25.4 |
| 7 | 50 | 50 | 24.6 |
| 8 | 60 | 40 | 23.8 |
| 9 | 70 | 30 | 23.1 |
| 10 | 80 | 20 | 22.3 |
| 11 | 90 | 10 | 21.5 |
| 12 | 100 | 0 | 20.8 |

Among general synthetic fibers, a 6,6-nylon has a surface tension of about 60 mN/m, and a polyester has a surface tension of about 45 mN/m. On the other hand, among natural fibers, a cotton has a surface tension of about 230 mN/m, a linen has a surface tension of about 68 mN/m, and a descaled sheep wool has a surface tension of about 200 mN/m. Thus, the surface tensions of the natural fibers such as the cotton and sheep wool are significantly larger than that of water. Therefore, in water washing or the like, such natural fibers tend to absorb a large amount of water, be swollen, and thereby be hardened, embrittled, whitened, or deformed.

As described above, in this embodiment, the surface tension of the modified fiber is controlled to be smaller than that of water and approximately equal to those of the synthetic fibers. Therefore, the natural fiber in the modified fiber can be prevented from swelling in the water washing or the like as is the case with the synthetic fibers. Consequently, the modified fiber can be effectively prevented from being hardened, embrittled, whitened, or deformed, and can exhibit excellent physical properties approximately equal to those of the synthetic fibers despite the existence of the natural fiber. Thus, the modified fiber can be excellent in softness, strength, washing durability, dyeing resistance, wrinkle resistance, etc.

Furthermore, since the hydrophilic functional groups in the natural fiber are not reacted with the silicone elastomer film, the modified fiber can draw water molecules due to the functional groups and thereby can show an excellent hygroscopicity.

Furthermore, on the surface of the modified fiber, the water molecules can penetrate into the natural fiber through the micropores in the silicone elastomer film. In addition, the water molecules can be desirably spread on the scale-like surface of the silicone elastomer film. Consequently, the modified fiber can satisfactorily maintain the inherent water absorbability of the natural fiber.

Thus, the modified fiber can have the excellent physical properties such as the softness, strength, washing durability, dyeing resistance, and wrinkle resistance equal to those of the synthetic fibers, and can further have the excellent hygroscopicity and water absorbability of the natural fiber higher than those of the synthetic fibers.

The silicone elastomer film further contains conductive fine particles containing zinc oxide as a main component. Specifically, the conductive fine particle contains an n-type semiconductor prepared by doping the zinc oxide with a trivalent metal. From the viewpoint of improving the conductivity, it is preferred that the zinc oxide is doped with the trivalent metal of at least one of aluminum and gallium.

In addition, from the viewpoint of improving the conductivity, the diameter of the conductive fine particles is preferably such that the primary particles have an average diameter of approximately 100 to 200 nm and the secondary particles have an average diameter of approximately 4 to 5 μm. The average diameters can be measured by a commercially available particle size analyzer or the like. For example, the particle size distribution of the conductive fine particles may be determined by a laser diffraction scattering method, and a particle diameter at the integration value of 50% (D50) in the distribution may be considered as the average diameter.

Since the silicone elastomer film containing the conductive fine particles dispersed is strongly attached to the surface of the modified fiber, the conductive fine particles are strongly held on the surface. Therefore, the conductive fine particles can be effectively prevented from being removed from the modified fiber in the process of washing, dyeing, or the like, so that the modified fiber can exhibit the excellent durability.

By strongly attaching the conductive fine particles to the modified fiber surface in the above manner, the modified fiber can be provided with additional functions to be hereinafter described. The functions are hardly deteriorated in the process of washing the modified fiber, and thus the modified fiber exhibits the excellent durability.

The conductive fine particle can absorb ultraviolet light, and can absorb and reflect infrared light. In contrast, visible light can be transmitted through the conductive fine particle. Thus, the conductive fine particle can act to provide the modified fiber with an ultraviolet shielding function and an infrared shielding function without deteriorating the color of the modified fiber. Furthermore, the conductive fine particle can act to improve the conductivity of the modified fiber, and therefore can act as an antistatic to effectively prevent electrostatic generation. In addition, the conductive fine particle can act to provide the modified fiber with excellent deodorant and antibacterial properties.

In general, a person wearing clothing often feels stimulation by the clothing when static electricity generated on the clothing surface acts on open skin pores or when a low-softness fiber is brought into contact with the open skin pores. The conductive fine particle containing the zinc oxide as a main component has an astringent function. Therefore, clothes made from the modified fiber containing the conductive fine particles can prevent the skin pores of the persons wearing the clothes from opening. Furthermore, as described above, in this modified fiber, the electrostatic generation can be prevented by the conductive fine particles, and the softness can be improved by the silicone elastomer film. Consequently, the stimulation on the clothed person can be reduced.

Next, steps for producing the modified fiber having the above basic structure will be described below using a production method according to this embodiment.

First, particles of the silicone elastomer, which contains the polyoxyethylene alkyl ether having 12 to 15 carbon atoms as a main component and has the siloxane skeleton, are dispersed in an aqueous dispersion medium such as water to prepare an aqueous dispersion liquid. This aqueous dispersion liquid can be obtained by appropriately controlling the concentration of a commercially available product such as X-51-1318 (trade name, available from Shin-Etsu Chemical Co., Ltd.)

The above-described conductive fine particles are further dispersed in the aqueous dispersion liquid. A commercially available product such as MH-2N (23-K) (trade name, available from Hakusui Tech Co., Ltd.) can be used as the conductive fine particles.

An adjuster for controlling the surface tension of the modified fiber product, such as an anionic softener, may be further added to the aqueous dispersion liquid. For example, the cross-linking degree of the silicone elastomer particles can be controlled, and thus the surface tension of the modified fiber can be appropriately controlled, by using the adjuster. A commercially available product such as Highsofter ATS-2 (trade name, available from Meisei Chemical Works, Ltd.) can be used as the adjuster.

The concentrations of the silicone elastomer particles, the conductive fine particles, and the adjuster in the aqueous dispersion liquid may be appropriately selected depending on the type, form, shape, and size of the fiber material in such a manner that the surface tension of the modified fiber is controlled within the range of 30 to 70 mN/m. For example, the surface tension can be easily controlled within the above range by using the aqueous dispersion liquid containing 0.1% to 10% by mass of the silicone elastomer particles, 0.1% to 20% by mass of the conductive fine particles, and 0.01% to 3% by mass of the adjuster.

The fiber material containing the natural fiber is immersed in thus obtained aqueous dispersion liquid, and the liquid is wrung out of the fiber material. Then, the fiber material is dried and subjected to a heating treatment, whereby the silicone elastomer particles are cross-linked with each other. As a result, the silicone elastomer film is formed, and the film is strongly attached to the natural fiber surface due mainly to the anchor effect, whereby the modified fiber is produced with a surface tension of 30 to 70 mN/m.

The heating treatment may be performed by a known heating apparatus such as a heat setter, and is preferably carried out in a steam set using a water vapor. In this case, for example, by using a saturated vapor having a temperature of 100° C. or lower, the silicone elastomer particles can be cross-linked, and the modified fiber can be produced with a further improved softness. Furthermore, the saturated vapor can penetrate even a narrow gap between stacked natural fiber pieces, and thereby can effectively supply heat over the entire natural fiber uniformly.

Therefore, in a case where the natural fiber is in the state of a yarn, it is particularly preferable to use the steam set. Thus, in a case where the natural fiber yarn is wound and then heat-treated, the saturated vapor can supply heat even to the natural fiber pieces inside the wound yarn to effectively form the silicone elastomer film.

In addition, in the steam set, the ambient atmosphere of the natural fiber can be filled with the saturated vapor to prevent generation of active oxygen or the like. Consequently, the modified fiber can be desirably prevented from being damaged or embrittled by the active oxygen.

In the modified fiber produced by the above steps, as described above, the silicone elastomer film, which can be expanded and contracted in response to deformation of the natural fiber, can be strongly attached to the natural fiber surface due mainly to the mechanical action such as the anchor effect. Thus, in this modified fiber, the silicone elastomer film can be strongly attached to the natural fiber, while most of the functional groups in the natural fiber can be reacted with a dye. Consequently, the modified fiber has the excellent dyeing affinity and can be easily piece-dyed.

The modified fiber has the controlled surface tension approximately equal to those of the synthetic fibers. Therefore, the modified fiber can be prevented from swelling in water washing or the like despite the existence of the natural fiber, and can exhibit the excellent physical properties such as the softness, strength, dyeing resistance, and wrinkle resistance approximately equal to those of the synthetic fibers.

Furthermore, since the functional groups are not chemically bonded with the silicone elastomer film, the modified fiber can draw water molecules due to the hydrophilicity of the functional groups and thereby can show the excellent hygroscopicity. In addition, since the silicone elastomer film is the porous film having a plurality of the micropores and has the scale-like surface, the modified fiber can exhibit the excellent water absorbability.

Furthermore, since the conductive fine particles are strongly held on the modified fiber surface, the modified fiber can maintain for a long time the ultraviolet shielding function, infrared shielding function, deodorant property, antibacterial property, antistatic property, hypoallergenic property, and the like.

The preferred embodiment of the present invention has been described above. The present invention is not limited to the embodiment, and various changes and modifications may be made therein without departing from the scope of the invention.

For example, though the silicone elastomer film contains the conductive fine particles in the above modified fiber, the silicone elastomer film is not particularly limited thereto. The aqueous dispersion liquid may be free of the conductive fine particles, and thus the silicone elastomer film free of the conductive fine particles may be formed on the surface of the modified fiber.

EXAMPLES

Example 1

The present invention will be described in more detail below with reference to Examples without intention of restricting the scope of the invention.

First, several examples of the modified fibers, obtained by forming silicone elastomer films free from conductive particles on the following fiber materials, will be described below. As the fiber materials, a material A containing 100% of a cotton, a material B prepared by blending the cotton and a sheep wool at 70:30, a material C prepared by blending the cotton and a silk at 70:30, a material D prepared by blending the cotton and a linen at 60:40, a material E prepared by blending the cotton and a regenerated cellulose at 80:20, and a material F prepared by blending the cotton and an ester at 35:65 were used.

The fiber material of the material A was used in the states of a yarn A1, woven fabrics A2, A3, and A4, knitted fabrics A5 and A6. The yarn A1 was a raw yarn of No. 20 single yarn. The woven fabric A2 was a flat-woven fabric containing 120 warp yarns per inch and 60 weft yarns per inch prepared by using No. 40 single yarn. The woven fabric A3 was a twill-woven fabric containing 108 warp yarns per inch and 58 weft yarns per inch prepared by using No. 20 single yarn. The woven fabric A4 was a flat-woven fabric containing 62 warp yarns per inch and 58 weft yarns per inch prepared by using No. 20 single yarn. The knitted fabric A5 was a circular rib fabric prepared by using No. 40 single yarn at 18-gauge, 30 inches diameter. The knitted fabric A6 was a plain stitch fabric prepared by using No. 20 single yarn at 20-gauge, 26 inches diameter.

The fiber material of the material B was used in the states of woven fabrics B1 and B2. The woven fabric B1 was a twill-woven fabric containing 90 warp yarns per inch and 70 weft yarns per inch prepared by using No. 30 single yarn. The woven fabric B2 was a twill-woven fabric containing 108 warp yarns per inch and 58 weft yarns per inch prepared by using No. 40 two-folded yarn.

The fiber material of the material C was used in the states of woven fabrics C1 and C2. The woven fabric C1 was a flat-woven fabric containing 90 warp yarns per inch and 88 weft yarns per inch prepared by using No. 60 single yarn. The woven fabric C2 was a twill-woven fabric containing 148 warp yarns per inch and 82 weft yarns per inch prepared by using No. 50 single yarn.

The fiber material of the material D was used in the state of a knitted fabric D1, which was a circular rib fabric prepared by using No. 40 single yarn at 18-gauge, 30 inches diameter. The fiber material of the material E was used in the state of a knitted fabric E1, which was a circular rib fabric prepared by using No. 60 single yarn at 22-gauge, 30 inches diameter. The fiber material of the material F was used in the state of a woven fabric F1, which was a flat-woven fabric containing 120 warp yarns per inch and 60 weft yarns per inch prepared by using No. 34 single yarn.

Among the fiber materials, the yarn A1 was pretreated with an aqueous solution containing 1 g/L of Scorerol 700 conc (trade name) available from Hokko Chemicals Co., Ltd. and 1 g/L of Sunmorl BH-75 (trade name) available from Nicca Chemical Co., Ltd. by a cheese dyeing machine.

The woven fabrics A2, A3, A4, C1, C2, and F1 were desized, scoured, singed, and bleached, respectively. The woven fabric F1 was preset by a heat setter.

The knitted fabrics A5 and A6 were desized, scoured, bleached, dehydrated, and dried, respectively.

The yarn was scoured and bleached twice by a cheese dyeing machine, and then dried to obtain the woven fabric B1. The woven fabric B1 was further desized, scoured, singed, cold-bleached, and washed. On the other hand, the woven fabric B2 was desized, scoured, and singed.

Then, aqueous dispersion liquids were prepared for modifying the fiber materials. Specifically, an aqueous dispersion liquid containing 10 g/L of the above-described X-51-1318 and 10 g/L of the above-described Highsofter ATS-2 was prepared for modifying the yarn A1. Furthermore, an aqueous dispersion liquid containing 2% by mass of the X-51-1318 and 1% by mass of the Highsofter ATS-2 was prepared for modifying the fiber materials other than the yarn A1 and the woven fabric B2 (the woven fabrics A2, A3, A4, B1, C1, C2, and F1, and the knitted fabrics A5, A6, D1, and E1). Furthermore, an aqueous dispersion liquid containing 6% by mass of the X-51-1318 and 1% by mass of the Highsofter ATS-2 was prepared for modifying the woven fabric B2.

The above-described Sunmorl BH-75 was added as a surfactant to the aqueous dispersion liquids for the knitted fabrics A6, D1, and E1 at ratios of 1%, 3%, and 2% by mass respectively. Furthermore, 3% by mass of Finetex NRW (trade name) available from DIC Corporation was added as a surfactant to the aqueous dispersion liquid for the woven fabric B2.

The above fiber materials were immersed in the aqueous dispersion liquids respectively. Specifically, the yarn A1 was immersed in the aqueous dispersion liquid at the ordinary temperature for 20 minutes, and dehydrated by using a cheese dehydrator available from Ueno Kikai Co., Ltd. Then, the resultant was dried using a high-pressure cheese dryer available from Nissen Co., Ltd., and was steam-set using a steam setter available from Nikku Industry Co., Ltd., to produce a modified fiber.

The fiber materials other than the yarn A1 (the woven fabrics A2, A3, A4, B1, B2, C1, C2, and F1, and the knitted fabrics A5, A6, D1, and E1) were immersed in the above aqueous dispersion liquids and then wrung respectively. In this step, the ratio of the weight of the adsorbed aqueous dispersion liquid to the weight of each fiber material measured before the immersion (wringing ratio) was controlled at 70%. The fiber materials were dried at 150° C. for 1 minute and 30 seconds by a heat setter available from IL SUNG MACHINARY, Co., Ltd., respectively.

Among the dried fiber materials, the knitted fabrics A5, A6, D1, and E1 were heat-treated at 170° C. for 2 minutes by using the above heat setter respectively. The other fiber materials (the woven fabrics A2, A3, A4, B1, B2, C1, C2, and F1) were heat-treated at 170° C. for 2 minutes by using a baking machine available from SANDO ENGINEERING Co., Ltd., respectively.

Then, the fiber materials other than the yarn A1, the woven fabric B2, and the knitted fabric D1 (the woven fabrics A2, A3, A4, B1, C1, C2, and F1, and the knitted fabrics A5, A6, and E1) were subjected to a shrink-proofing process to produce modified fibers respectively.

In contrast, the woven fabric B2 was further desized, scoured, bleached twice, and dried. The woven fabric B2 was immersed in an aqueous dispersion liquid containing 4% by mass of the X-51-1318 and 3% by mass of the Highsofter ATS-2, and then dried in the same manner as above. The resultant was subjected to a wrinkle resistant finishing using a glyoxal solution containing 7% by mass of Beckamine NF-30 and 2% by mass of NFC-1 (trade names, both available from DIC Corporation). Then, the woven fabric B2 was heat-treated using the baking machine and subjected to the shrink-proofing process in the same manner as above, to produce a modified fiber.

The knitted fabric D1 was further desized, scoured, bleached, dehydrated, and dried after the above heating treatment. The knitted fabric D1 was immersed in an aqueous dispersion liquid containing 2% by mass of the X-51-1318, 1% by mass of the Highsofter ATS-2, and 2% by mass of the Sunmorl BH-75, and then dried in the same manner as above. Then, the resultant was subjected to the shrink-proofing process in the same manner as above to produce a modified fiber.

Thus, each of the woven fabric B2 and the knitted fabric D1 was subjected to a modification treatment twice for forming a silicone elastomer film.

Incidentally, the yarn A1 was treated as follows after the above modification treatment. Thus, the formed yarn A1 was scoured and bleached by a method described in Japanese Laid-Open Patent Publication No. 2012-026053 using a highly efficient soft flow dyeing machine available from Sekido Tekko Ltd. Then, the yarn A1 was dehydrated and dried using a centrifugal dehydrator and a tumbler dryer available from Asahi Seisakusho Co., Ltd.

The modified fibers of Example 1 were thus produced. The fiber materials, which were not modified in the above manner (i.e. do not have the silicone elastomer films), were used as samples of Comparative Example 1.

Furthermore, water-repellent/oil-repellent-treated fibers of Comparative Examples 2, 3, and 4 were produced by attaching a water-absorbing silicone, a dimethyl silicone, or an amino silicone (which are known as silicone resins useful for a water-repellent/oil-repellent treatment of a general fiber) to the surface of the woven fabric A3 respectively. Specifically, the water-repellent/oil-repellent-treated fiber of Comparative Example 2 was produced by impregnating the woven fabric A3 with a treatment liquid containing 3% by mass of Nicca Silicone AQ77 (trade name) available from Nicca Chemical Co., Ltd. and by wringing, drying, and heating the resultant.

The water-repellent/oil-repellent-treated fiber of Comparative Example 3 was produced in the same manner as Comparative Example 2 except for using a treatment liquid containing 3% by mass of Nicca Silicone DM100E (trade name) available from Nicca Chemical Co., Ltd. instead of the above treatment liquid.

The water-repellent/oil-repellent-treated fiber of Comparative Example 4 was produced in the same manner as Comparative Example 2 except for using a treatment liquid containing 3% by mass of Nicca Silicone AMC800 (trade name) available from Nicca Chemical Co., Ltd. instead of the above treatment liquid.

<Surface Tension>

The surface tensions of the woven fabrics A2, A3, B1, C1, and F1 and the knitted fabric A5 of Example 1 and Comparative Example 1 were measured before water washing (0 times) and after performing the washing 100 times respectively. The washing was carried out using a home electric washing machine VH-30S available from Toshiba Corporation. Specifically, water and each measurement sample were added into the washing tub such that 1 kg of the measurement sample was used per 30 L of water (i.e. at the bath ratio of 1:30). The washing was carried out at a water temperature of 30° C. to 40° C. for 15 minutes under a strong water flow condition. This process was repeated 100 times, and the surface tension of the measurement sample washed 100 times was measured. The surface tensions were measured by the above-described Dupont method. The comparison results are shown in Table 2.

TABLE 2

| | | | Surface tension (mN/m) | |
|---|---|---|---|---|
| | | | Example 1 | Comparative Example 1 |
| A2 | Washing | 0 | 42 | 230 |
| | (times) | 100 | 50 | 230 |
| A3 | Washing | 0 | 42 | 230 |
| | (times) | 100 | 50 | 230 |
| A5 | Washing | 0 | 33 | 230 |
| | (times) | 100 | 42 | 230 |
| B1 | Washing | 0 | 42 | 230 |
| | (times) | 100 | 50 | 230 |
| C1 | Washing | 0 | 42 | 230 |
| | (times) | 100 | 50 | 230 |
| F1 | Washing | 0 | 33 | 230 |
| | (times) | 100 | 42 | 230 |

As shown in Table 2, all the surface tensions of the modified fibers of Example 1, measured before washing and after washed 100 times, were within the range of 30 to 70 mN/m. In contrast, the surface tensions of the fiber materials of Comparative Example 1 (i.e. the inherent surface tensions of the unmodified fiber materials) were 230 mN/m. Thus, the surface tension of each fiber material can be lowered by forming the silicone elastomer film on the fiber material surface, and the resultant modified fiber can exhibit a surface tension controlled approximately equal to those of synthetic fibers. Consequently, as described above, the modified fiber can exhibit excellent physical properties equal to those of the synthetic fibers despite the existence of the above fiber material.

Even in a case where the woven fabrics A2 and A3 of Example 1 were heat-treated using a steam set instead of the above baking machine, the surface tensions were approximately 70 mN/m before the washing. Thus, it was confirmed that the modified fibers could exhibit the controlled surface tensions approximately equal to those of the synthetic fibers also in this case.

Furthermore, in the modified fibers of Example 1, the surface tensions measured after washed 100 times could be approximately equal to those measured before the washing. Thus, in each modified fiber, the silicone elastomer film can be strongly attached to the fiber material, can be prevented from being peeled off in the washing, and can exhibit an excellent durability.

Next, the surface tensions of the woven fabrics A3 of Example 1 and Comparative Examples 2 to 4 were measured before washing, after performing the washing 10 times, before dyeing, and after dyeing, respectively. The washing was carried out in the same manner as above.

The dyeing was carried out by a dip dyeing process using a drum-type dyeing machine NF-70 (trade name) available from Nissin Machinery Pte Ltd. under the following conditions. In the process, a colorant containing 0.8% o.w.f. (mass ratio to fiber) of Su HF YELLOW 3R, 0.64% o.w.f. of Su HF SCARLET 2G, 0.72% o.w.f. of Su HF BLUE BG, 40 g/L of a salt cake, and 10 g/L of a soda ash was used. Furthermore, the bath ratio was 1:20, and the dyeing conditions were at 60° C. for 40 minutes.

The surface tensions were measured by the above-described Dupont method. The comparison results are shown in Table 3.

TABLE 3

| | | | Surface tension (mN/m) | | | |
|---|---|---|---|---|---|---|
| | | | Example 1 | Comparative Example 2 | Comparative Example 3 | Comparative Example 4 |
| A3 | Washing | 0 | 42 | >72 | >72 | 51 |
| | (times) | 10 | 50 | >72 | >72 | >72 |
| | Dyeing | Before | 42 | >72 | >72 | 51 |
| | | After | 50 | >72 | >72 | >72 |

As is clear from Table 3, in the modified fiber of Example 1, the surface tensions, measured before being washed, after washed 10 times, and before and after the dyeing, were within the range of 30 to 70 mN/m and approximately equal to those of the synthetic fibers. Thus, in this modified fiber, the silicone elastomer film is not peeled off from the fiber material surface even in the process of the dyeing, and can exhibit an excellent durability.

In Comparative Examples 2 and 3, it was difficult to obtain the water-repellent/oil-repellent-treated fibers with controlled surface tensions approximately equal to those of the synthetic fibers. Furthermore, in Comparative Example 4, though the water-repellent/oil-repellent-treated fiber could exhibit the surface tensions equal to those of the synthetic fibers before the washing and dyeing, the controlled surface tensions could not be maintained in the process of the washing and dyeing. Thus, even in a case where the silicone resins (useful for the water-repellent/oil-repellent treatment of the general fiber) are attached to the fiber material surface, the resins are readily peeled off in the process of the washing and dyeing, thereby failing to achieve a satisfactory durability.

<Dyeing Affinity>

The yarns A1, the woven fabrics A3, B1, and C2, and the knitted fabrics A5 of Example 1 and Comparative Example 1 were dyed (dip-dyed) under the above dyeing conditions. Then, the color differences (ΔE) between Example 1 and Comparative Example 1 were measured to evaluate the dyeing affinities. The results are shown in Table 4. The color differences were calculated from lightness values measured using a colorimeter CR-410 available from Konica Minolta, Inc. Specifically, the color differences can be calculated using the following equation (1).

$$\Delta E=[(\Delta L)^2+(\Delta a)^2+(\Delta b)^2]^{1/2} \quad (1)$$

In the equation, ΔL, Δa, and Δb represent differences of L* values, a* values, and b* values between the modified fibers of Example 1 and the fiber materials of Comparative Example 1 respectively.

TABLE 4

| | Dyeing affinity (dip dyeing) | | | | | | |
|---|---|---|---|---|---|---|---|
| | Example 1 | | | Comparative Example 1 | | | |
| | L* | a* | b* | L* | a* | b* | ΔE |
| A1 | 37.42 | 9.29 | 6.44 | 36.88 | 9.51 | 6.23 | 0.62 |
| A3 | 41.82 | 11.3 | 9.59 | 41.02 | 10.21 | 9.02 | 1.47 |
| A5 | 43.45 | 10.71 | 9.04 | 42.32 | 9.98 | 8.83 | 1.36 |

TABLE 4-continued

| | Dyeing affinity (dip dyeing) | | | | | | |
|---|---|---|---|---|---|---|---|
| | Example 1 | | | Comparative Example 1 | | | |
| | L* | a* | b* | L* | a* | b* | ΔE |
| B1 | 37.51 | 9.29 | 6.17 | 36.85 | 8.55 | 5.92 | 1.02 |
| C2 | 45.8 | 11.03 | 9.69 | 45.1 | 10.05 | 9.33 | 1.26 |

As shown in Table 4, all of the modified fibers of Example 1 exhibited the color differences of 1.5 or less from the fiber materials of Comparative Example 1. Thus, in Example 1, the dyeing process was not inhibited by the silicone elastomer films, and the modified fibers exhibited sufficient dyeing affinities.

Meanwhile, the woven fabrics A2 of Example 1 and Comparative Example 1 were subjected to a printing process respectively. The lightness values of the printed fabrics were measured using the colorimeter CR-410. The results are shown in Table 5.

TABLE 5

| | | Dyeing affinity (printing) | | | | | |
|---|---|---|---|---|---|---|---|
| | | Example 1 | | | Comparative Example 1 | | |
| | | L* | a* | b* | L* | a* | b* |
| A2 | RED | 37.86 | 52.45 | 22.91 | 36.07 | 48.75 | 19.74 |
| | BROWN | 48.75 | 16.27 | 26.68 | 46.5 | 13.82 | 22.56 |
| | NAVY | 27.12 | 6.32 | −18.9 | 25.79 | 4.75 | −16.4 |

As is clear from Table 5, also in the case of the printing, the modified fiber of Example 1 exhibited a sufficient dyeing affinity approximately equal to that of the natural fiber of Comparative Example 1.

Thus, the dyeing affinity of the fiber material was not deteriorated by the silicone elastomer film strongly attached to the surface as described above, and the modified fiber could be easily piece-dyed.

<Softness>

The bending properties of the woven fabrics A4 and the knitted fabrics A6 of Example 1 and Comparative Example 1 were measured using an automatic pure bending tester KES-FB2-AUTO-A available from Kato Tech Co., Ltd. to evaluate the softnesses respectively. Specifically, a test specimen having a size of 20 cm×20 cm was prepared and fixed between chucks arranged at a distance of 1 cm. Then, the specimen was bent forward to a maximum curvature of +2.5 $cm^{-1}$, bent backward to a maximum curvature of −2.5 $cm^{-1}$, and then returned to the initial shape, so that the bending stiffness B and the bending hysteresis 2HB were measured. The results are shown in Table 6.

TABLE 6

| | | Softness | |
|---|---|---|---|
| | | Example 1 | Comparative Example 1 |
| A4 | Bending stiffness B (gf · $cm^2$/cm) | 0.074 | 0.159 |
| | Bending hysteresis 2HB (gf · cm/cm) | 0.062 | 0.202 |
| A6 | Bending stiffness B (gf · $cm^2$/cm) | 0.038 | 0.056 |
| | Bending hysteresis 2HB (gf · cm/cm) | 0.039 | 0.063 |

As is clear from Table 6, the bending stiffness B values and the bending hysteresis 2HB values of the modified fibers of Example 1 were smaller than those of the fiber materials of Comparative Example 1. Thus, the modified fibers were softer, more recoverable from the bent state, and more flexible than the unmodified fiber materials.

<Wrinkle Resistance>

The wrinkle resistances of the yarns A1, the woven fabrics A3 and B2, and the knitted fabrics A5, D1, and E1 of Example 1 and Comparative Example 1 were evaluated before and after washing or before and after dyeing respectively. Specifically, the wrinkle recovery angles were measured before and after the washing and before and after the dyeing according to JIS L 1059 B method (Monsanto method). The results are shown in Table 7.

TABLE 7

| | | | Wrinkle resistance (%) | | | |
|---|---|---|---|---|---|---|
| | | | Example 1 | | Comparative Example 1 | |
| | | | Warp | Weft | Warp | Weft |
| A1 | Washing | 0 | 46.0 | 55.0 | 36.0 | 45.0 |
| | (times) | 100 | 31.0 | 51.0 | 31.0 | 42.0 |
| A3 | Washing | 0 | 59.0 | 61.0 | 45.0 | 56.0 |
| | (times) | 100 | 62.0 | 63.0 | 49.0 | 54.0 |
| | Dyeing | Before | 52.8 | 58.5 | 30.2 | 16.5 |
| | | After | 54.3 | 58.3 | 22.7 | 13.3 |
| A5 | Washing | 0 | 64.2 | 70.0 | 28.9 | 54.5 |
| | (times) | 100 | 56.8 | 69.5 | 35.2 | 56.8 |
| | Dyeing | Before | 39.2 | 52.6 | | |
| | | After | 36.9 | 51.8 | | |
| B2 | Washing | 0 | 59.0 | 65.0 | 49.0 | 53.0 |
| | (times) | 50 | 49.0 | 47.0 | 43.0 | 40.0 |
| D1 | Washing | 0 | 41.7 | 49.5 | 32.7 | 46.3 |
| | (times) | 50 | 39.0 | 42.0 | 28.5 | 40.8 |
| E1 | Washing | 0 | 39.0 | 42.0 | 33.0 | 34.0 |
| | (times) | 50 | 34.0 | 35.0 | 32.0 | 28.0 |

As is clear from the results of Table 7, the modified fibers of Example 1 exhibited improved wrinkle resistances higher than those of the fiber materials of Comparative Example 1. Furthermore, the modified fibers of Example 1 could maintain the higher wrinkle resistances in the washing process and the dyeing process as compared with the fiber materials of Comparative Example 1.

<Tear Strength>

The tear strengths of the woven fabrics A2, A3, B1, B2, C1, C2, and F1 of Example 1 and Comparative Example 1 were measured respectively according to JIS L 1096 D method (pendulum method). Specifically, 5 test specimens having a size of 63 mm×about 100 mm of each fabric were prepared. Both ends of each specimen were held by an Elmendorf tear strength tester such that the short sides extended in the warp direction. On the long side of the specimen, a 20-mm cut extending perpendicular to the long side was formed approximately at the center of the long side. Then, a load was applied such that the both ends of the specimen were pulled in opposite directions. The applied load (N) was measured as the warp tear strength when the weft yarns in the remaining 43-mm portion were torn. The weft tear strength could be measured in the same manner as the warp tear strength except that the long sides of the specimen extended in the warp direction. The results are shown in Table 8.

TABLE 8

| | | | Tear strength (N) | | | |
|---|---|---|---|---|---|---|
| | | | Example 1 | | Comparative Example 1 | |
| | | | Warp | Weft | Warp | Weft |
| A2 | Washing | 0 | 13.8 | 8.6 | 8.5 | 5.9 |
| | (times) | 100 | 13.2 | 8.7 | 6.0 | 4.7 |
| | Dyeing | Before | 13.8 | 8.6 | | |
| | (printing) | After | 14.2 | 10.5 | | |
| A3 | Dyeing | Before | 39.3 | 23.3 | 30.2 | 16.5 |
| | | After | 33.7 | 25.5 | 22.7 | 13.3 |
| B1 | Washing | 0 | 41.1 | 33.1 | 14.5 | 8.9 |
| | (times) | 100 | 44.6 | 35.8 | 10.7 | 8.3 |
| | Dyeing | Before | 41.1 | 33.1 | | |
| | | After | 35.2 | 31.5 | | |
| B2 | Washing | 0 | 47.8 | 47.7 | 38.3 | 41.2 |
| | (times) | 50 | 26.2 | 44.0 | 14.1 | 12.1 |
| C1 | Washing | 0 | 15.6 | 14.0 | 11.2 | 8.0 |
| | (times) | 100 | 14.1 | 11.4 | 6.6 | 5.0 |
| C2 | Washing | 0 | 23.7 | 23.4 | 15.0 | 12.9 |
| | (times) | 100 | 20.7 | 21.6 | 9.1 | 7.3 |
| | Dyeing | Before | 23.7 | 23.4 | | |
| | | After | 18.6 | 20.3 | | |
| F1 | Washing | 0 | 39.4 | 24.5 | 15.6 | 9.2 |
| | (times) | 50 | 39.9 | 24.7 | 15.4 | 11.1 |

As is clear from Table 8, the modified fibers of Example 1 exhibited higher tear strengths than those of the fiber materials of Comparative Example 1 in both of the warp and weft directions. Furthermore, the modified fibers of Example 1 could maintain the higher tear strengths in the washing process and the dyeing process as compared with the fiber materials of Comparative Example 1.

The tear strengths of the woven fabrics A2 of Example 1 and Comparative Example 1 were measured in the above manner before raising treatments, after a one-side raising treatment, and after a both-sides raising treatment respectively. The raising treatments were carried out using a sueding machine available from Mario Crosta under conditions of a brush revolution rate of 1350 rpm, a contact pressure of 70%, and a speed of 10 m/min. The results are shown in Table 9.

TABLE 9

| | | Tear strength (N) | | | |
|---|---|---|---|---|---|
| | | Example 1 | | Comparative Example 1 | |
| | | Warp | Weft | Warp | Weft |
| A2 | Before raising | 13.8 | 10.8 | 8.5 | 5.9 |
| | After one-side raising | 13.9 | 11.0 | 8.4 | 4.3 |
| | After both-sides raising | 13.3 | 10.7 | | |

As is clear from Table 9, the modified fibers of Example 1 could maintain the higher tear strengths in the one-side raising and both-sides raising treatments as compared with the fiber materials of Comparative Example 1.

<Burst Strength>

The burst strengths of the knitted fabrics A5 of Example 1 and Comparative Example 1 were measured respectively according to JIS L 1096 A method (Mullen method). Specifically, 5 test specimens having a size of 15 cm×15 cm of each fabric were prepared. Each specimen was held by a clamp under a uniform tensile force in a Mullen burst tester with the front surface facing upward. A pressure was applied to the back surface of the specimen by a rubber film. The applied pressure A (kgf/cm$^2$) was measured when the rubber film burst through the specimen, and the pressure B (kgf/cm$^2$) applied only on the rubber film at the time of the burst was measured. The burst strength Bs (kgf/cm$^2$) was obtained using the following equation (2). The average value of the burst strengths in the 5 specimens was calculated. The results are shown in Table 10.

$$Bs=A-B \tag{2}$$

TABLE 10

| | | | Burst strength (kgf/cm$^2$) | |
|---|---|---|---|---|
| | | | Example 1 | Comparative Example 1 |
| A5 | Dyeing | Before | 3.4 | 3.3 |
| | | After | 4.2 | 4.2 |

As is clear from Table 10, the modified fiber of Example 1 exhibited a burst strength approximately equal to that of the fiber material of Comparative Example 1, and the burst strength was not deteriorated in the dyeing process.

<Anti-Discoloration Property>

The dyed color preservation properties during washing, i.e. the anti-discoloration properties, of the woven fabrics A2, A3, B1 and B2, and the knitted fabrics E1 of Example 1 and Comparative Example 1 were evaluated respectively. Specifically, the color difference ΔE between before washing and after performing the washing 100 times with respect to each fabric was measured by a measurement method using the colorimeter CR-410. First, the lightness of each of the modified fibers of Example 1 and the fiber materials of Comparative Example 1 was measured before the washing. Then, the washing of each fabric was repeated 100 times under the above conditions. The fabric was rinsed at a temperature of 30° C. or lower for 2 minutes twice, dehydrated, and suspended and dried. Then, the lightness of the fabric was measured, and the color difference ΔE was calculated using the above equation (1). The results are shown in Table 11.

TABLE 11

| | | | Anti-discoloration property | | | | | | | |
|---|---|---|---|---|---|---|---|---|---|---|
| | | | Example 1 | | | | Comparative Example 1 | | | |
| | | | L* | a* | b* | ΔE | L* | a* | b* | ΔE |
| A2 | Washing | 0 | 22.26 | 3.4 | −5.13 | 0.20 | 23.26 | 3.54 | −4.98 | 1.11 |
| | (times) | 100 | 22.45 | 3.46 | −5.14 | | 22.24 | 3.55 | −5.42 | |
| A3 | Washing | 0 | 21.94 | 3.44 | −5.37 | 0.35 | 22.8 | 3.54 | −4.83 | 0.97 |
| | (times) | 100 | 22.23 | 3.28 | −5.48 | | 21.97 | 3.4 | −5.32 | |
| B1 | Washing | 0 | 23.51 | 3.08 | −6.04 | 0.64 | 24.86 | 3.07 | −6.46 | 1.07 |
| | (times) | 100 | 23.71 | 3.18 | −6.44 | | 23.79 | 3.17 | −6.48 | |
| B2 | Washing | 0 | 54.41 | 2.54 | −3.40 | 0.66 | 54.59 | 2.69 | −2.93 | 1.66 |
| | (times) | 100 | 53.90 | 2.87 | −3.13 | | 52.93 | 2.73 | −3.04 | |
| E1 | Washing | 0 | 21.62 | 3.32 | −5.28 | 0.13 | 21.25 | 3.24 | −5.17 | 1.17 |
| | (times) | 100 | 21.73 | 3.26 | −5.25 | | 22.2 | 3.15 | −5.02 | |

As is clear from Table 11, the modified fibers of Example 1 exhibited smaller color differences between before and after the washing as compared with the fiber materials of Comparative Example 1. Thus, in the modified fibers, whitening, discoloration, and the like could be effectively prevented in the washing process.

<Color Fastness to Rubbing>

The woven fabrics A2 of Example 1 and Comparative Example 1 were subjected to a test of color fastness to rubbing according to JIS L 0849 respectively. Specifically, first, each of the woven fabrics A2 (test specimen) was dyed and developed under the following conditions. Thus, the fabric was dyed with a colorant containing 60 g/L of Sumifix Supra Black E-XF (trade name) available from Sumitomo Chemical Co., Ltd. using a pad dryer available from Watetsu. Then, the fabric was black-colored by a developer containing 200 g/L of a mirabilite anhydride, 50 g/L of a soda ash, and 10 g/L of sodium hydroxide using a pad steamer available from Sando Tech, Inc.

The specimen and a rubbing cloth of white cotton were reciprocated in the warp direction 1000 times at a constant speed using Gakushin-type rubbing tester II. In this step, a load of 2 N was applied to the specimen and the rubbing cloth. The specimen and the rubbing cloth of white cotton were each compared under a standard light with a contamination grayscale (JIS L 0805) to evaluate the color fastness. The contamination grayscale was used as a standard for visually evaluating the contamination on the white cloth. The contamination grayscale had 1st to 5th grade scales with prescribed color differences, and the sample was classified into 9 classes of 1st grade, 1st-2nd grade, 2nd grade, 2nd-3rd grade, etc. The 1st grade means that the white cloth was most contaminated.

As a result of the above test, the modified fiber of Example 1 was evaluated as 4th grade, and the fiber material of Comparative Example was evaluated as 1st-2nd grade. Thus, the modified fiber could exhibit an effectively improved color fastness to rubbing as compared with the unmodified fiber material.

<Dimensional Change after Washing>

The dimensional change rate of the woven fabric B2 of Example 1 during washing was evaluated. Specifically, first, 20-cm straight lines were drawn on 3 portions in a test specimen in each of the warp and weft directions. The lengths of the straight lines in the warp and weft directions were measured after the specimen was washed by the above washing process 10 times, 30 times, and 50 times respectively. The ratio of each length measured after the washing to the initial length measured before the washing was calculated as the dimensional change rate. The results are shown in Table 12.

TABLE 12

| | | | Dimensional change rate (%) | |
|---|---|---|---|---|
| | | | Warp | Weft |
| B2 | Washing (times) | 10 | −4.1 | −2.0 |
| | | 30 | −4.2 | −1.2 |
| | | 50 | −4.0 | −1.3 |

As shown in Table 12, the modified fiber exhibited the dimensional change rates of less than −5% in the warp direction and −2% or less in the weft direction even after repeating the washing 10 times, 30 times, and 50 times. Thus, in the modified fiber, the dimensional changes by the washing could be effectively prevented.

<Residual Water Content after Dehydration>

The residual water contents after washing and dehydration of the woven fabrics A2, A3, B1, and C1 and the knitted fabrics A5 and E1 of Example 1 and Comparative Example 1 were evaluated respectively. Specifically, first, each test specimen was dried at 105° C. for 2 hours, and the dry weight (g) was measured. Then, the specimen was washed in the same manner as above except that the washing time was 30 minutes. The specimen was dehydrated for 5 minutes, and the weight of the resultant specimen was measured as the after-dehydration weight (g). This process was repeated 12 times, and the average of 12 values calculated using the following equation (3) was considered as the residual water content (%) after dehydration.

$$\text{Residual water content}=(\text{After-dehydration weight}-\text{Dry weight})/\text{Dry weight} \quad (3)$$

Then, the specimen was washed 100 times in the same manner as above, and the residual water content (%) after dehydration was calculated in the same manner as above. The results are shown in Table 13.

TABLE 13

| | | | Residual water content (%) | |
|---|---|---|---|---|
| | | | Example 1 | Comparative Example 1 |
| A2 | Washing (times) | 0 | 81.5 | 93.0 |
| | | 100 | 108.5 | 122.4 |
| A3 | Washing (times) | 0 | 70.3 | 86.1 |
| | | 100 | 98.1 | 107.5 |
| A5 | Washing (times) | 0 | 81.9 | 102.1 |
| | | 100 | 104.2 | 116.1 |
| B1 | Washing (times) | 0 | 87.0 | 108.1 |
| | | 100 | 118.7 | 128.4 |
| C1 | Washing (times) | 0 | 80.2 | 92.4 |
| | | 100 | 114.9 | 119.6 |
| E1 | Washing (times) | 0 | 91.0 | 115.8 |

As is clear from Table 13, the modified fibers of Example 1 exhibited the residual water contents lower than those of the fiber materials of Comparative Example 1. Thus, the modified fibers could be dried after the washing and dehydration in a shorter time as compared with the unmodified fiber materials. Furthermore, the modified fibers of Example 1 could maintain the lower residual water contents and were more excellent in quick-drying properties even after repeating the washing as compared with the fiber materials of Comparative Example 1.

<Hygroscopicity>

The hygroscopicities (water contents) of the knitted fabrics A5 and E1 of Example 1 and Comparative Example 1 were evaluated respectively according to Boken method by a general incorporated foundation Boken Quality Evaluation Institute. Specifically, first, each test specimen was exposed under conditions of 40° C. and 90% RH for 4 hours in a moisture absorption process, and was exposed under conditions of 20° C. and 65% RH for 4 hours in a moisture desorption process. In the processes, the mass (g) of the specimen was hourly measured, and the hygroscopicity (%) was calculated from the mass changes. The results are shown in Table 14.

TABLE 14

| | Hygroscopicity (%) Example 1 | | | | | | | |
|---|---|---|---|---|---|---|---|---|
| Conditions (RH) | 40° C. × 90% | | | | 20° C. × 65% | | | |
| Time (h) | 1 | 2 | 3 | 4 | 5 | 6 | 7 | 8 |
| A5 | 9.4 | 9.9 | 10.2 | 10.3 | 7.4 | 7.2 | 7.2 | 7.2 |
| E1 | 10.2 | 11.5 | 12.0 | 12.3 | 8.9 | 8.5 | 8.4 | 8.4 |
| | Comparative Example 1 | | | | | | | |
| Conditions (RH) | 40° C. × 90% | | | | 20° C. × 65% | | | |
| Time (h) | 1 | 2 | 3 | 4 | 5 | 6 | 7 | 8 |
| A5 | 8.8 | 10.2 | 10.8 | 11.1 | 8.0 | 7.6 | 7.6 | 7.6 |
| E1 | 9.9 | 11.5 | 12.4 | 12.8 | 9.0 | 8.6 | 8.6 | 8.5 |

As is clear from Table 14, the hygroscopicities of the modified fibers of Example 1 were approximately equal to those of the fiber materials Comparative Example 1. Thus, the modified fibers could satisfactorily maintain the inherent hygroscopicities of the fiber materials, and could exhibit the excellent hygroscopicities.

<Water Absorbability>

The water absorbabilities of the woven fabrics A2 and A3 and the knitted fabrics A5 and E1 of Example 1 and Comparative Example 1 were evaluated by Byreck method of JIS L 1907 respectively. Specifically, first, 5 test specimens having a size of about 200 mm×25 mm of each fabric were prepared. The specimens of the woven fabrics A2 and A3 had this size in the warp and weft directions, and the specimens of the knitted fabrics A5 and E1 had this size in the wale and course directions. Then, in each specimen, a lower end having a length of 20 mm±2 mm was immersed in water for 10 minutes. The level of water raised due to capillarity in the specimen was measured on 1-mm scale. The results are shown in Table 15.

TABLE 15

| | Water absorption amount (mm) | | | |
|---|---|---|---|---|
| | Example 1 | | Comparative Example 1 | |
| | Warp | Weft | Warp | Weft |
| A2 | 37 | 22 | 67 | 25 |
| A3 | 50 | 39 | 81 | 28 |
| A5 | 51 | 51 | 132 | 108 |
| E1 | 95 | 72 | 133 | 90 |

As is clear from Table 15, the modified fibers of Example 1 could maintain sufficient water absorbabilities as compared with the fiber materials of Comparative Example 1.

As described above, when the modified fiber is provided with the controlled surface tension approximately equal to those of the synthetic fibers, the modified fiber can exhibit the improved physical properties approximately equal to those of the synthetic fibers, such as the dyeing affinity, the softness, the wrinkle resistance, the tear strength, the anti-discoloration property, the dimensional change rate during washing, and the residual water content after dehydration, while satisfactorily maintaining the inherent hygroscopicity and water absorbability of the natural fiber. Furthermore, the physical properties of the modified fiber can be prevented from being deteriorated in the washing process, and the modified fiber can have the excellent durability.

Example 2

Modified fibers of Example 2, which were produced by forming silicone elastomer films containing conductive particles on the woven fabrics A2, A3, B1, C1, C2, and F1, the knitted fabrics A5, A6, and D1, and a towel A7 respectively, will be described below. The towel A7 was produced from the No. 20 single yarn of the material A.

Among the fiber materials, the woven fabrics A2, A3, B1, C1, C2, and F1 and the knitted fabrics A5, A6, and D1 were processed in the same manner as Example 1 except for the modification treatment respectively. An aqueous dispersion liquid prepared by mixing 5% by mass of the X-51-1318 and 10% by mass of the MH-2N was used in the modification treatment. The modified fibers were produced in the same manner as Example 1 except for the modification treatment.

The towel A7 was desized, scoured, and bleached using a highly efficient soft flow dyeing machine. Then, the towel A1 was dehydrated using a centrifugal dehydrator and dried using a continuous dryer.

In the modification treatment of the towel A7, an aqueous dispersion liquid was prepared by mixing 3% by mass of the X-51-1318, 10% by mass of the MH-2N, 0.5% by mass of the Highsofter ATS-2, and 2% by mass of the Sunmorl BH-75. The towel A1 was immersed in the aqueous dispersion liquid using a mangle processing machine available from Ichikin Co., Ltd. The resultant was dried using a continuous dryer available from Anglada, and then heat-treated by a steam set using a steam setter available from Nikku Industry Co., Ltd., to produce the modified fiber.

The modified fibers of Example 2 were produced in the above manner, and the physical properties were evaluated as follows.

<Dyeing Affinity>

The woven fabrics A2, A3, B1, and C2 and the knitted fabrics A5 of Example 2 and Comparative Example 1 were dyed (dip-dyed) under the above dyeing conditions. Then, the color differences (ΔE) between Example 2 and Comparative Example 1 were measured to evaluate the dyeing affinities. The results are shown in Table 16.

TABLE 16

| | Dyeing affinity | | | | | | |
|---|---|---|---|---|---|---|---|
| | Example 2 | | | Comparative Example 1 | | | |
| | L* | a* | b* | L* | a* | b* | ΔE |
| A2 | 32.26 | 6.97 | −17.37 | 30.51 | 7.06 | −17.54 | 1.76 |
| A3 | 43.62 | 10.99 | 8.67 | 42.98 | 10.33 | 8.45 | 0.95 |
| A5 | 41.34 | 10.54 | 7.40 | 40.88 | 10.04 | 7.15 | 0.72 |
| B1 | 39.83 | 9.15 | 5.27 | 39.34 | 8.85 | 5.01 | 0.63 |
| C2 | 47.60 | 10.82 | 8.91 | 47.05 | 10.3 | 7.98 | 1.20 |

As shown in Table 16, all of the modified fibers of Example 2 exhibited the color differences of 1.8 or less from the fiber materials of Comparative Example 1. Thus, in Example 2, the dyeing process was not inhibited by the silicone elastomer films, and the modified fibers exhibited sufficient dyeing affinities.

<Wrinkle Resistance>

The wrinkle resistances of the woven fabric A3 and the knitted fabric A5 of Example 2 were evaluated before and after dyeing respectively in the same manner as above. The results are shown in Table 17.

TABLE 17

| | | | Wrinkle resistance (%) Example 2 | |
|---|---|---|---|---|
| | | | Warp | Weft |
| A3 | Dyeing | Before | 50.9 | 53.0 |
| | | After | 52.2 | 55.6 |
| A5 | Dyeing | Before | 41.8 | 50.7 |
| | | After | 39.7 | 48.8 |

As is clear from Table 17, also the modified fibers of Example 2 exhibited excellent wrinkle resistances.

<Tear Strength>.

The tear strengths of the woven fabrics A2, A3, B1, and C2 of Example 2 were measured before and after dyeing respectively in the same manner as above. The results are shown in Table 18.

TABLE 18

| | | | Tear strength (N) Example 2 | |
|---|---|---|---|---|
| | | | Warp | Weft |
| A2 | Dyeing (printing) | Before | 12.0 | 7.84 |
| | | After | 12.3 | 8.62 |
| A3 | Dyeing | Before | 35.4 | 19.8 |
| | | After | 34.1 | 23.4 |
| B1 | Dyeing | Before | 35.3 | 30.8 |
| | | After | 36.0 | 32.0 |
| C2 | Dyeing | Before | 20.4 | 16.3 |
| | | After | 18.0 | 18.1 |

As is clear from Table 18, the modified fibers of Example 2 exhibited higher tear strengths before and after the dyeing.

<Burst Strength>

The burst strengths of the knitted fabrics A5 of Example 2 and Comparative Example 1 were evaluated before and after dyeing respectively in the same manner as above. The results are shown in Table 19.

TABLE 19

| | | | Burst strength (kgf/cm$^2$) | |
|---|---|---|---|---|
| | | | Example 2 | Comparative Example 1 |
| A5 | Dyeing | Before | 3.8 | 3.3 |
| | | After | 4.5 | 4.2 |

As is clear from Table 19, the modified fiber of Example 2 exhibited a higher burst strength as compared with the fiber material of Comparative Example 1, and the burst strength was not deteriorated in the dyeing process.

<UV Shielding Ratio>

The UV shielding ratios of the woven fabrics A2, A3, B1, C1, and F1 and the knitted fabrics A5 of Example 2 and Comparative Example 1 were evaluated respectively using an ultraviolet-visible-near infrared spectrophotometer UV-3150 (trade name) available from Shimadzu Corporation. Specifically, the transmittance of each test specimen was measured at a wavelength of 220 to 380 nm, and a value calculated by subtracting the measured value from 100 was considered as the UV shielding ratio. The results are shown in Table 20.

TABLE 20

| | UV shielding ratio (%) | |
|---|---|---|
| | Example 2 | Comparative Example 1 |
| A2 | 87 | 75 |
| A3 | 94 | 81 |
| A5 | 85 | 76 |
| B1 | 88 | 84 |
| C1 | 80 | 73 |
| F1 | 87 | 84 |

As is clear from Table 20, the modified fibers of Example 2 exhibited the UV shielding ratios higher than those of the fiber materials of Comparative Example 1. Thus, the modified fibers could effectively absorb the ultraviolet light due to the conductive fine particles in the silicone elastomer films.

<Infrared Absorption>

The infrared absorption properties of the woven fabrics A2, B1, and C1 and the knitted fabrics A5 and F1 of Example 2 and Comparative Example 1 were compared with each other as follows. Specifically, first, each test specimen was placed through an opening in a box (inner volume 60 ml) having a heat insulation cork formed on a side wall. A thermocouple temperature sensor was further placed in the box at a distance of 2 mm from the specimen. One surface of the specimen faced the thermocouple temperature sensor, and the other surface was irradiated with a 100-W infrared light from a near infrared lamp. The near infrared lamp was IR100/110V100WR available from Toshiba Corporation, and was placed at a distance of 150 mm from the specimen. The temperature of the test room was 25° C.±2° C., and the humidity was 40%±5% RH.

The box was irradiated with the infrared light through the specimen, and the inner temperature of the box was raised. The temporal temperature change was measured over 20 minutes by the thermocouple temperature sensor. Using the measured values, the difference between Example 2 and Comparative Example 1 of the temperatures measured 15 minutes after the start of the irradiation from the near infrared lamp was calculated, and the infrared absorption properties were compared with each other.

The measurement was carried out before washing of each specimen and after performing the washing 100 times in the above manner. The results are shown in Table 21.

TABLE 21

| | | | Temperature (° C.) | | |
|---|---|---|---|---|---|
| | | | Example 2 | Comparative Example 1 | Difference |
| A2 | Washing | 0 | 48.53 | 51.04 | 2.51 |
| | (times) | 100 | 46.3 | 48.29 | 1.99 |
| A5 | Washing | 0 | 45.8 | 48.61 | 2.81 |
| | (times) | 100 | 43.83 | 45.14 | 1.31 |
| B1 | Washing | 0 | 47.14 | 49.98 | 2.84 |
| | (times) | 100 | 44.72 | 47.93 | 3.21 |
| C1 | Washing | 0 | 49.98 | 47.14 | 2.84 |
| | (times) | 100 | 47.93 | 44.72 | 3.21 |
| F1 | Washing | 0 | 47.14 | 49.17 | 2.03 |
| | (times) | 100 | 43.7 | 45.35 | 1.65 |

As is clear from Table 21, the temperature increase by the infrared irradiation was smaller in the modified fibers of Example 2 than in the fiber materials of Comparative Example 1. Thus, the modified fibers could absorb and reflect the infrared light effectively.

<Friction-Charged Electrostatic Potential>

The friction-charged electrostatic potentials of the woven fabrics A2, A3, B1, C1, and F1 and the knitted fabrics A5, A6, and D1 of Example 2 and Comparative Example 1 were evaluated respectively according to "5.2 Friction-charged electrostatic potential measurement method" in "Testing methods for electrostatic propensity of woven and knitted fabrics" of JIS L 1094.

Specifically, a rotary drum was rotated in a friction-charged electrostatic potential measurement machine to rub each test specimen having a size of 50 mm×80 mm. The electrostatic potential (V) was measured 60 seconds after the start of the rubbing. The measurement was carried out 5 times while rubbing the specimen in each of the warp and weft directions, and the average of the measured values were used as the friction-charged electrostatic potential. The results are shown in Table 22. Incidentally, the test room temperature was 20° C.±2° C., and the humidity was 40%±2% RH. A cotton/wool attached white cloth was used as a friction cloth.

TABLE 22

| | | | Friction-charged electrostatic potential (V) | | | |
|---|---|---|---|---|---|---|
| | | | Example 2 | | Comparative Example 1 | |
| | | | Warp | Weft | Warp | Weft |
| A2 | Friction cloth | Cotton | 240 | 240 | 840 | 580 |
| | | Wool | 720 | 690 | 1200 | 1100 |
| A3 | Friction cloth | Cotton | 150 | 120 | 360 | 230 |
| | | Wool | 590 | 500 | 890 | 800 |
| A5 | Friction cloth | Cotton | 310 | 400 | 350 | 190 |
| | | Wool | 1100 | 1300 | 790 | 1600 |
| A6 | Friction cloth | Cotton | 160 | 180 | 290 | 190 |
| | | Wool | 670 | 910 | 770 | 1100 |
| B1 | Friction cloth | Cotton | 150 | 180 | 500 | 460 |
| | | Wool | 610 | 450 | 660 | 590 |
| C1 | Friction cloth | Cotton | 240 | 310 | 1100 | 1500 |
| | | Wool | 680 | 760 | 1200 | 1300 |
| D1 | Friction cloth | Cotton | 63 | 90 | 66 | 110 |
| | | Wool | 340 | 270 | 450 | 510 |
| F1 | Friction cloth | Cotton | 520 | 500 | 2400 | 1500 |
| | | Wool | 1100 | 990 | 2900 | 2000 |

As is clear from Table 22, the modified fibers of Example 2 exhibited the friction-charged electrostatic potentials smaller than those of the fiber materials of Comparative Example 1. Thus, the modified fibers could reduce static charge to effectively prevent electrostatic generation or the like. Consequently, the modified fibers could prevent also adsorption of pollen, dust, or the like.

<Surface Resistance>

The surface resistances of the woven fabrics A2 of Example 2 and Comparative Example 1 were measured respectively by two-point resistance measurement according to IEC (International Electrotechnical Commission) standard 61340-5-1. The results are shown in Table 23. The measurement was carried out under conditions of an applied voltage of 100 V, a test room temperature of 23° C.±3° C., and a test room humidity of 25%±3% RH.

TABLE 23

| | Surface resistance (Ω) | |
|---|---|---|
| | Example 2 | Comparative Example 1 |
| A2 | $2.9 \times 10^{12}$ | $1.1 \times 10^{13}$ |

As is clear from Table 23, the modified fiber of Example 2 had a lower surface resistance than the fiber material of Comparative Example 1. Thus, the modified fiber could exhibit an excellent conductivity.

<Deodorant Property>

The deodorant properties against ammonia, hydrogen sulfide, isovaleric acid, acetic acid, and indole of the woven fabric A2 and the towel A7 of Example 2 was evaluated respectively. Specifically, the deodorant properties against ammonia and acetic acid were measured as follows according to an instrumental analysis (detector tube method) by general incorporated association Japan Textile Evaluation Technology Council. The deodorant properties of each test specimen were measured before washing and after performing the washing 100 times in the above manner.

First, 2.4 g of the specimen was put in a 5-L Tedlar bag and was sealed tightly. Then, 3 L of each odor component gas was injected into the Tedlar bag by a syringe at a predetermined initial concentration. 2 hours after the injection of the odor component gas, the concentration of the odor component gas in the Tedlar bag was measured by a detector tube. A blank test was carried out in the same manner, and the odor component reduction rate was calculated using the following equation (4). The initial concentrations of ammonia and acetic acid were 100 and 4 ppm respectively.

$$\text{Reduction rate (\%)} = \{(\text{Measured value in blank test after 2 hours} - \text{Measured value of specimen after 2 hours})/\text{Measured value in blank test after 2 hours}\} \times 100 \quad (4)$$

The deodorant properties against isovaleric acid were evaluated as follows according to a gas chromatography method by general incorporated association Japan Textile Evaluation Technology Council. 1.2 g of each specimen was placed in a 500-mL conical flask, an ethanol solution of the odor component was added thereto dropwise at a predetermined initial concentration, and the conical flask was sealed. After 2 hours, a sample was taken by a syringe, and the concentration of the odor component was measured by a gas chromatography. A blank test was carried out in the same manner, and the odor component reduction rate was calculated using the above equation (4). The initial concentration of isovaleric acid was about 14 ppm. The results are shown in Table 24.

TABLE 24

| | | | Reduction rate (%) | | | | |
|---|---|---|---|---|---|---|---|
| | | | Ammonia | Hydrogen sulfide | Isovaleric acid | Acetic acid | Indole |
| A2 | Washing (times) | 0 | 83 | 82 | 96 | ≥95 | 95 |
| | | 100 | 90 | 95 | 97 | ≥96 | 94 |
| A7 | Washing (times) | 0 | 72 | 85 | 97 | ≥97 | 98 |
| | | 100 | 81 | 92 | ≥99 | ≥98 | 97 |

As is clear from Table 24, the modified fibers of Example 2 exhibited sufficient deodorant properties against all the odor components of ammonia, hydrogen sulfide, isovaleric acid, acetic acid, and indole. Furthermore, the modified fibers could satisfactorily maintain the deodorant properties even after performing the washing 100 times, and could exhibit the excellent deodorant properties for a long time.

<Antibacterial Property>

The antibacterial properties against a *Staphylococcus aureus*, a *Klebsiella pneumoniae*, an MRSA (methicillin-resistant *Staphylococcus aureus*), a *moraxella osloensis*, an *Escherichia coli*, a *Pseudomonas aeruginosa*, and a *salmonella* bacterium of the woven fabric A2 and the towel A1 of Example 2 were evaluated respectively. Specifically, in this evaluation, the bacteriostatic activity and the bactericidal activity were measured by "10.1 bacterial suspension absorption method" in "Testing for antibacterial activity and efficacy on textile products" of JIS L 1902:2008. The activities of the test specimen were measured before washing and after performing the washing 100 times in the above manner. Incidentally, when the bacteriostatic activity was 2.2 or more or the bactericidal activity was 0 or more, the specimen was considered to have an antibacterial effect.

The bacteriostatic activity measurement results are shown in Table 25, and the bactericidal activity measurement results are shown in Table 26.

| | | Antibacterial property (bacteriostatic activity) | | | | | | |
|---|---|---|---|---|---|---|---|---|
| | | *Staphylococcus aureus* | *Klebsiella pneumoniae* | MRSA | *Moraxella osloensis* | *Escherichia coli* | *Pseudomonas aeruginosa* | *Salmonella bacterium* |
| A2 | Washing 0 | 5.2 | 4.4 | 3.5 | >6.2 | 3.6 | >6.2 | >6.2 |
| | (times) 100 | >5.8 | >6.2 | 4.1 | >6.1 | >6.0 | >6.1 | >5.8 |
| A7 | Washing 0 | >5.8 | >6.2 | >5.6 | >6.2 | 4.6 | 4.5 | >6.2 |
| | (times) 100 | 4.7 | >6.2 | 4.8 | >6.2 | >5.9 | >6.2 | >5.8 |

| | | Antibacterial property (bactericidal activity) | | | | | | |
|---|---|---|---|---|---|---|---|---|
| | | *Staphylococcus aureus* | *Klebsiella pneumoniae* | MRSA | *Moraxella osloensis* | *Escherichia coli* | *Pseudomonas aeruginosa* | *Salmonella bacterium* |
| A2 | Washing 0 | 2.6 | 1.5 | 1.0 | >3.1 | 1.6 | 1.4 | >3.1 |
| | (times) 100 | >3.2 | >3.2 | 1.7 | >3.1 | >3.1 | >3.0 | >3.1 |
| A7 | Washing 0 | >3.2 | >3.2 | >3.2 | >3.1 | 0.8 | >3.0 | >3.1 |
| | (times) 100 | 2.1 | >3.2 | 2.4 | >3.1 | >3.1 | >3.0 | >3.1 |

As is clear from Tables 25 and 26, the modified fibers of Example 2 exhibited bacteriostatic activities of 2.2 or more and bactericidal activities of 0 or more against all the bacteria mentioned above. Furthermore, the modified fibers could maintain the bacteriostatic activities and the bactericidal activities within the above ranges even after performing the washing 100 times. Thus, the modified fibers could exhibit excellent antibacterial properties and could maintain the properties for a long time.

The invention claimed is:

1. A modified fiber obtained by modifying a fiber material containing at least one of a cellulosic fiber and an animal fiber, wherein a film of a silicone elastomer is attached to at least a portion of a surface of the fiber material without forming a chemical bond with a hydrophilic functional group of the fiber material, the hydrophilic functional group of the fiber material being capable of forming a chemical bond with a dye, the silicone elastomer contains a polyoxyethylene alkyl ether having 12 to 15 carbon atoms as a main component and has a siloxane skeleton, a surface of the modified fiber has a surface tension of 30 to 70 mN/m, the silicone elastomer film is a porous film having a plurality of micropores, and the silicone elastomer film has a scale shape, and the dye is capable of reaching the fiber material through the silicone elastomer film.

2. The modified fiber according to claim 1, wherein the film of the silicone elastomer contains conductive fine particles, and the conductive fine particles contain an n-type semiconductor containing zinc oxide as a main component.

3. The modified fiber according to claim 2, wherein the zinc oxide is doped with at least one of aluminum and gallium.

4. The modified fiber according to claim 1, wherein the silicone elastomer film comprises an anionic softener.

5. A modified fiber obtained by modifying a fiber material containing at least one of a cellulosic fiber and an animal fiber, wherein a film of a silicone elastomer is attached to at least a portion of a surface of the fiber material without forming a chemical bond with a hydrophilic functional group of the fiber material, the hydrophilic functional group of the fiber material forms a chemical bond with a dye, the silicone elastomer contains a polyoxyethylene alkyl ether having 12 to 15 carbon atoms as a main component and has a siloxane skeleton, a surface of the modified fiber has a surface tension of 30 to 70 mN/m, the silicone elastomer film is a porous film having a plurality of micropores, and the silicone elastomer film has a scale shape.

6. The modified fiber according to claim 5, wherein the film of the silicone elastomer contains conductive fine particles, and the conductive fine particles contain an n-type semiconductor containing zinc oxide as a main component.

7. The modified fiber according to claim 6, wherein the zinc oxide is doped with at least one of aluminum and gallium.

* * * * *